US005446527A

United States Patent [19]

Yasuda et al.

[11] Patent Number: 5,446,527

[45] Date of Patent: Aug. 29, 1995

[54] METHOD OF FORMING FIXED IMAGES

[75] Inventors: Shin-ichiro Yasuda, Osaka; Kuniyasu Kawabe, Wakayama; Mitsuhiro Sasaki, Wakayama; Harumasa Yamasaki, Wakayama, all of Japan

[73] Assignee: Kao Corporation, Tokyo, Japan

[21] Appl. No.: 175,437

[22] PCT Filed: Jul. 22, 1992

[86] PCT No.: PCT/JP92/00934

§ 371 Date: Jan. 12, 1994

§ 102(e) Date: Jan. 12, 1994

[87] PCT Pub. No.: WO93/02403

PCT Pub. Date: Feb. 4, 1993

[30] Foreign Application Priority Data

Jul. 24, 1991 [JP] Japan ..... 3-208426

[51] Int. Cl.[6] ..... G03G 13/20

[52] U.S. Cl. ..... 355/279; 355/282; 430/99; 430/124

[58] Field of Search ..... 355/285, 290, 289, 279, 355/24, 23, 210, 211, 212, 245, 274, 277, 271, 282; 430/109, 138, 124, 126, 97

[56] References Cited

U.S. PATENT DOCUMENTS

| | | | |
|---|---|---|---|
| 3,776,723 | 12/1973 | Royka et al. . | |
| 3,924,945 | 12/1975 | Weigl . | |
| 4,439,462 | 3/1984 | Tarumi et al. . | |
| 4,885,220 | 12/1989 | Kuhman et al. | 430/31 |
| 4,999,272 | 3/1991 | Tanikawa et al. | 430/106.6 |
| 5,013,630 | 7/1991 | Ong et al. | 430/138 |
| 5,045,422 | 9/1991 | Kmiecik-Lawrynowicz et al. | 430/109 |
| 5,089,363 | 2/1992 | Rimai et al. | 430/45 |
| 5,108,860 | 4/1992 | Birkle et al. | 430/57 |
| 5,112,717 | 5/1992 | Baxter et al. | 430/124 |
| 5,162,189 | 11/1992 | Pierce et al. | 430/126 |
| 5,196,288 | 3/1993 | Nakamura | 430/138 |
| 5,225,308 | 7/1993 | Sasaki et al. | 430/138 |
| 5,234,782 | 8/1993 | Aslam et al. | 430/99 |
| 5,334,476 | 8/1994 | Yagi et al. | 430/126 |

FOREIGN PATENT DOCUMENTS 2097947 11/1982 United Kingdom .

OTHER PUBLICATIONS

"Patent Abstract of Japan" vo. 14, No. 442 (P-1104) 12 Sep. 1990 & JP,A, 02 163 749 (Canon) 4 Dec. 1984 (see abstract).

"Patent Abstract of Japan" vol. 9, No. 86 (P-349) (1809) 16 Apr. 1985 JP,A, 59 214 862 (Toshiba) 4 Dec. 1984 (see abstract).

*Primary Examiner*—A. T. Grimley
*Assistant Examiner*—Thu Dang
*Attorney, Agent, or Firm*—Birch Stewart Kolasch & Birch

[57] ABSTRACT

A method of forming fixed images includes charging a photoconductor; exposing the photoconductor to light; developing an electrostatic latent image, such that a toner is applied to the electrostatic latent image formed on a transfer film moving in partially close contact with the photoconductor to form a visible image; transferring the formed visible image onto a recording medium such as a recording paper; and fixing the transferred visible image onto the recording medium. The toner is an encapsulated toner, the photoconductor is a heat-resistant photoconductor, and the transfer process and the fixing process are simultaneously carried out on the surface of the heat-resistant photoconductor covered with the transfer film onto the preheated recording medium.

9 Claims, 4 Drawing Sheets

METHOD OF FORMING FIXED IMAGES

TECHNICAL FIELD

The present invention relates to a method of forming fixed images used for plain paper copying machines, laser printers, plain paper facsimiles, etc. More particularly, the present invention relates to a method of forming images in which transfer and fixing are simultaneously carried out on the surface of the heat-resistant photoconductor covered with a transfer film using a recording medium whose surface is heated in advance.

BACKGROUND ART

Conventionally, when images are formed with copying machines, laser beam printers, etc., the Carlson Method has been generally used (U.S. Pat. Nos. 2,221,776, 2,297,691 and 2,357,809, "Electrophotography," p22–p41, R. M. Shaffert, 1965, The Focal Press).

FIG. 2 shows a schematic view of an apparatus used in a conventional method of forming fixed images. In the conventional method, after an electrostatic latent image formed on a photoconductor by optical means is developed in a developing process, it is transferred to a recording medium such as a recording paper in a transfer process and then fixed into the final image generally with heat and pressure in a fixing process. As the photoconductor is repeatedly used, a cleaning device is provided for cleaning the residual toner after the transfer process with its rotation.

In the conventional method of forming fixed images, however, the processes from the formation of the electrostatic latent image up to its fixing onto the recording medium are time consuming, which makes the apparatus used therein not only complicated but also large. In addition, since the transfer efficiency of the toner is poor in the transfer process, it poses such problems as extra labor needed for the disposal of the toner collected by cleaning the residual toner, and pollution due to the scattering of the toner in and out of the apparatus.

Therefore, a method of simultaneously conducting transferring and fixing has been proposed (U.S. Pat. No. 4,448,872). In this method, since the transferring and fixing are simultaneously carried out by pressing the toner image developed on the dielectric drum to the recording medium, the simplification of the apparatus can be surely achieved. However, since only pressure is applied at fixing, the fixing ability is poor, and little improvement is achieved in transfer efficiency.

The fixing of the toner should be generally conducted at a high temperature due to the high melting temperature of the toner, thereby requiring an apparatus with high thermal efficiency. The fixing process usually works independently, and is carried out at such a high temperature of around 200° C. Accordingly, expensive heat-resistant materials such as heat-resistant resins, heat-resistant rubbers, etc. have to be provided in the periphery of the fixing device.

In addition, when the fixing is carried out at a high temperature, it is subject to problems such as curling and jamming of the paper, etc. Therefore, taking into consideration of the radiation from the apparatus, a device highly capable of radiating heat is in demand. Further, if the fixing requires a high temperature, it takes more time to reach the set temperature so that a quick printing becomes impossible. In such a case, therefore, this method is unsuitable for devices such as a facsimile which requires quick printings.

Further, in view of solving the problems, there has been proposed a method of forming fixed images, wherein the transfer and fixing process is simultaneously carried out by adhering the toner onto a transfer film, which rotates while keeping it partly in close contact with a photoconductor to form a toner image, and putting the recording paper and the transfer film between a pressure roller and a heat roller provided away from the photoconductor (Japanese Patent Laid-Open No. 197884/1990).

According to this method, however, when the transfer film is wound around the pressure roller, one of the pair of rollers for transfer and fixing, and a heat roller is arranged on the outside of the transfer film, the recording medium, which is heated from the reverse side, such as paper, etc. having insulating effects has a poor thermal efficiency, and thereby a sufficient heat required for fixing cannot be supplied to the toner. Therefore, problems arise in that fixing becomes insufficient. On the other hand, when the transfer film is wound around the heat roller and the pressure roller is arranged on the outside of the transfer film, the heating material is arranged in the inside of the film belt, causing problems in radiation from the internal portion of the film belt. When the heating material is arranged inside the film belt, the radiation conditions are likely to be insufficient, thereby causing deterioration in sensitivity and decrease in durability of the photoconductor due to heat. In addition, since the fixing is carried out through the film, problems may arise in the delaying of the transmission of heat, thereby presumably demanding a higher fixing temperature for the heat roller.

Further, in the conventional method of forming fixed images, however, through the processes from the formation of the electrostatic latent image up to its fixing onto the recording medium, the temperature of the heating material of the fixing device has to remain at a very high level (usually around 200° C.) and further a relatively high pressure is required (usually between 2.0 and 6.0 kg/cm). On the other hand, since both the photoconductor and the developing device have to be maintained at around room temperature, a considerable distance has to be maintained between the fixing device and the developing device, which necessitates to make the machine larger. In addition, it is necessary to force the removal of the generated heat from the system, but the noise produced by the forced radiation device is not negligible.

As for solving these problems, a device for carrying out low temperature fixing using a cold pressing method (Japanese Patent Laid-Open No. 159174/1984) is known. In this reference, however, although the fixing temperature is low, the nip pressure has to be elevated normally to not less than 4 kg/cm in this method, making the machine heavier. Moreover, it poses problems in the gloss of the images, deformation of the paper copy sheets and insufficient fixing strength. As for a fixing device for fixing images at such a low nip pressure of less than 4 kg/cm, a heat roller method is known, for example, but it has been pointed out that the fixing temperature needs to be maintained at not less than 120° C.

Under these circumstances, the development of a fixing device that can fix images at a low temperature and at a low nip pressure is highly desired, but it has not yet been developed. Further, as regards toners to be indispensably used for the image formation, since they have been confined to those made from a thermoplastic resin dispersed with additives such as coloring agents, charge control agents, releasing agents, etc., and pulverized, there have been limitations on the molecular weight, the softening point of the thermoplastic resin for use in the toner from the aspect of storage stability, thereby posing limitations on the further pursuit of low temperature fixing.

From these standpoints, the development of a novel method of forming fixed images as well as a matching toner therefor is in demand.

DISCLOSURE OF INVENTION

An object of the present invention is to provide a novel method of forming fixed images, which solves the various problems as mentioned above, thereby namely achieving good transfer efficiency, no disposed toner and miniaturization of the image forming device.

Therefore, in view of solving the above-mentioned problems, the present inventors have investigated a toner shell material which is fragile to heat at a low temperature. As a result, they have found that a thermally dissociating encapsulated toner produced by interfacial polymerization melts at a temperature of not more than 120° C., and they have further investigated the image formation method using this encapsulated toner and have thus developed the present invention.

More particularly, in view of solving the above problems, the method of forming fixed images of the present invention comprises charging a photoconductor; exposing the photoconductor to light; developing an electrostatic latent image whereby a toner is applied to the electrostatic latent image formed on the transfer film moving in partially close contact with the photoconductor to form a visible image; transferring the formed visible image onto a recording medium such as a recording paper; and fixing the transferred visible image onto a recording medium, wherein the toner is an encapsulated toner, the photoconductor is a heat-resistant photoconductor, and the transfer process and the fixing process are simultaneously carried out on the surface of the heat-resistant photoconductor covered with a transfer film onto a preheated recording medium.

The heat-resistant photoconductor is a silicon photoconductor, a zinc oxide photoconductor dispersed in resin or an organic photoconductor, and the photoconductor comprises a binder having a glass transition point of not less than 100° C.

In the present invention, the transfer film is a photopermeant film in accordance with the wavelength of the light source.

In addition, the transfer process and the fixing process are simultaneously carried at a position between the transfer film and one roller or one belt.

Further, the preheating temperature of the recording medium is at a range of between not less than 50° C. and not more than 160° C.

According to the present invention, the visible image formed on the transfer film moving in partially close contact with the photoconductor drum in the developing process is simultaneously transferred and fixed to the recording medium whose surface is heated in advance. Therefore, the transfer and fixing process can be remarkably simplified. Also, since substantially all of the toner in the developing process is transferred and fixed, the disposed toner remaining untransferred does not take place, making it unnecessary to leave extra space for the disposed toner. Accordingly, the device can be remarkably miniaturized. Also, the radiator can be made much smaller due to its low fixing temperature, thereby achieving the miniaturization of an image-forming apparatus. In addition, since an independent transfer process is not required, an adjustment of electric resistance for the recording medium such as recording paper is not also required. By using a photoconductor having a good heat resistance, the durability of the photoconductor becomes longer, thereby remarkably increasing its reliability, and the photoconductor can be miniaturized.

BRIEF DESCRIPTION OF DRAWINGS

The present invention will become more fully understood from the detailed description given hereinbelow and the accompanying drawings which are given by way of illustration only, and thus, are not limitative of the present invention, and wherein.

Figure 1:
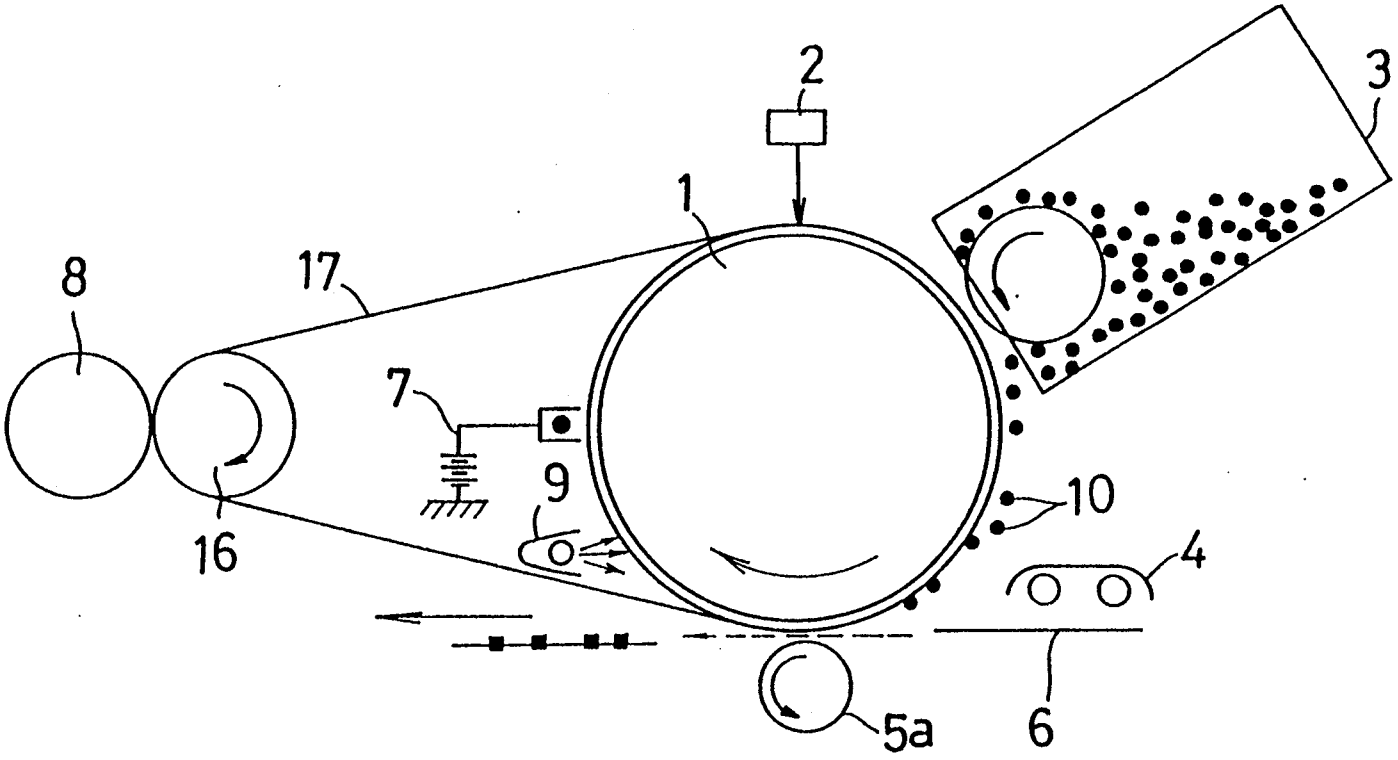
FIG. 1 is a schematic view of an apparatus used in the method of forming fixed images as defined by the present invention.

The reference numerals in FIGS. 1 through 6 denote the following elements:

Element 1 is a photoconductor, element 1*a* a photoconductive layer, element 1*b* a conductive supporter, element 2 an exposure device, element 3 a developer device, element 3*a* a rotating sleeve, element n a heater, element 5*a* a pressure roller, element 5*b* a transfer device, element 6 a recording medium (a recording paper, etc.), element 7 a charger, element 8 a cleaner device, element 8*a* a toner collecting box, element 9 a charge eraser, element 10 a toner, element 16 a holding roller, and element 17 a transfer film.

BEST MODE FOR CARRYING OUT THE INVENTION

The method of forming fixed images of the present invention are detailed below, .referring to the drawings.

FIG. 1 is a schematic view of an apparatus used in the method of forming fixed images as defined by the present invention. Element 1 is a heat-resistant photoconductor. For photoconductors, those practically used are photoconductors of selenium, silicon, organic groups, etc. However, in the present invention, since the photoconductor is exposed to a considerable amount of heat, the silicon photoconductors, the zinc oxide resin-dispersed photoconductors and the organic photoconductors having good heat resistance are preferred.

A silicon photoconductor is composed of amorphous silicon or silicon carbide (Japanese Patent Laid-Open No. 86341/1979), and for example, the p-type photoconductor to which boron atoms are doped to the amorphous silicon or the n-type photoconductor to which phosphorus atoms are doped to the amorphous silicon can be used.

As zinc oxide resin-dispersed photoconductors, those having a photoconductive layer comprising zinc oxide fine particles, sensitizer dyes and binders can be used (U.S. Pat. No. 2,952,536). From the viewpoint of not only in the sensitivity but also in the chargeability of the photoconductor, the zinc oxide fine particles preferably have a particle size of 0.1 to 1 μm. The sensitizer dyes are appropriately chosen in accordance with the wavelength of the light source in the exposure device. Examples thereof include xanthene dyes such as Rose Bengal, etc., triphenylmethane dyes such as Crystal Violet, etc., thiazine dyes such as Methylene Blue, etc. and cyanine dyes.

The organic photoconductors are single- or multilayered photoconductor having a photoconductive layer comprising materials capable of generating charges and transporting charges and binders, on the conductive supporter can be used. Examples of the charge generation materials include perylene pigments, condensed ring quinone pigments, phthalocyanine pigments, bisazo pigments, trisazo pigments, squarylium pigments, etc., with preference given to the perylene pigments and phthalocyanine pigments. Examples of the charge transport materials include hydrazone derivatives, pyrazoline derivatives, oxadiazole derivatives, arylamine derivatives, styrile derivatives, etc., with preference given to the arylamine derivatives.

The binders which can be preferably used for the heat-resistant photoconductor in the present invention have glass transition points of not less than 100° C. Typical examples thereof include condensation polymers such as polycarbonates, polyarylates, polyesters, polyamides, etc., addition polymers such as polymethacrylate, styrenemethacrylate copolymer, polyacetal, etc. and thermosetting resins such as epoxy resins, phenol resins, silicone resins, urethane resins, urea resins, etc. When the above binders are used, those having a glass transition point of less than 100° C. are undesirable because the adhesion of the toner and blurring of the latent image take place.

Any of the above photoconductors can be used as the heat-resistant photoconductors for the present invention, as long as its photoconductive layer has a glass transition point of normally not less than 100° C. to meet the requirement in heat resistance.

Element 7 is a charger located opposite to the photoconductor 1. The charging means is not particularly restricted, and any of, for instance, a corona charger, a brush charger, a roller charger, etc. can be used.

Element 2 is an exposure device located opposite to the photoconductor 1 for forming electrostatic latent images on the photoconductor surface. For an exposure device 2, light sources such as laser beams, LED or EL arrays, etc. are used in combination with an image-forming optical system. Alternatively, a device based on optical systems projecting a reflected light of a document generally provided in the copying machine can be used.

Element 3 is a developer device located opposite to the photoconductor 1 for making visible the electrostatic latent image formed on the photoconductor with the toner. For a developer device, any of the commonly used two-component magnetic brush developer device, the one-component magnetic brush developer device, the one-component non-magnetic developer device, etc. can be used.

As shown in FIG. 1, in the method of the present invention, a transfer film 17 which moves in partially close contact with a heat-resistant photoconductor is used to form an electrostatic latent image by adhering the toner on the transfer film. It is necessary for the transfer film 17 to have good heat resistance, since it is exposed to heat transmitted from the recording-medium which is preheated to a temperature of 50° C. to 160° C. It also should have a certain level of an insulating property as well as photopermeability in accordance with the wavelength emitted in the exposing process. The transfer film is not particularly restricted as long as it has a good photopermeability in accordance with the wavelength of such a light source. Examples of such transfer films include those made of PVA film, PET film, polymethylpentene film, cellophane, polycarbonate film, ethylene-vinyl alcohol copolymer film, etc. In addition, taking into consideration of the lines of electric forces generated at the time of developing, the thickness of the transfer film 17 is preferably not more than 200 μm, and taking into consideration of the tensile strength as well as the easiness in handling, it is preferably not less than 10 μm. The transfer film 17 is stretched with, for instance, the photoconductor 1 and the holding roller 16. The number of the holding rollers is not particularly restricted.

Element 4 is a heater, and element **5*a* is a pressure roller, and the heater 4 is disposed just before the point where the photoconductor 1 which is in close contact with the transfer film 17 contacts the pressure roller 5*a*, so that the preheated recording medium can be conveyed to the pressure roller. In addition, although the distance between the photoconductor and the heater is preferably kept as little as possible for the purpose of preventing the decrease in the surface temperature of the paper, the heater 4 is preferably set at a proper distance from the photoconductor so as not to cause thermal effects or thermal deformation on the photoconductor. The heater is normally arranged at a distance of about 2 to 10 cm away from the point where the photoconductor contacts the pressure roller. In addition, in order to increase preheating efficiency, the heater is preferably arranged nearly in parallel with the upper portion of the conveying route for the recording paper. The heater 4 is a device for preheating the surface of the recording medium such as a recording paper, wherein the surface comes in contact with the toner. As long as it is a device capable of heating the surface of the recording medium up to 160° C., any type of heat source can be used for the heater 4. Heating materials of the heater 4 include, for example, a hot plate, a quartz heater, a flash heater, a heating belt, a heater element, etc., with preference given to the quartz heater and the heater element. The pressure roller 5*a* is a means for pressure-welding the preheated recording medium onto the surface of the photoconductor covered with the transfer film 17**. In an ordinary fixing device, it is necessary to use heat-resistant silicone rubbers, etc. in order to carry out fixing at a high temperature. However, in the present invention, it is not required to use the pressure roller having a particularly high heat resistance, since the pressure roller in contact with the reverse side of the preheated recording medium is not directly heated. Therefore, as long as the materials for the pressure roller are elastic bodies having a good heat resistance at not less than 150° C., there are no limitations on its materials, and any of the ordinary inexpensive elastic materials including, for instance, heat-resistant polyurethane resins, acrylic resins, nitrile resins and non-conjugated diene terpolymer resins such as EPDM can be used. In addition, since the nip pressure of the pressure roller is usually 0.1 to 4.0 kg/cm, preferably 0.2 to 2 kg/cm, the durability thereof becomes longer. Incidentally, in the present invention, a belt may be used for a similar means in the place of the pressure roller.

After the transfer and fixing process, the cleaner device 8 such as a cleaning web for removing trace amounts of the toner remaining on the transfer film is arranged opposite to the holding roller 16.

The photoconductor 1, the pressure roller 5*a* and the holding roller 16 rotate at a constant peripheral speed in the direction shown in FIG. 1 by a specified driving means not illustrated in the figure. As a result, the transfer film 17 moves in the direction shown by an arrow in the figure by a frictional force caused between the photoconductor 1 and the holding roller 16. The transfer film comes in close contact with the surface of the photoconductor after carrying out the charging process and before entering the exposing process, and the transfer film is removed from the surface of the photoconductor after the transfer and fixing process. On the other hand, a recording paper 6 used as a recording medium is conveyed in the manner shown in FIG. 1, which after passing the pressure roller 5*a* is discharged out of the system by a paper discharging means not illustrated in the figure. In this connection, the conveying speed of the recording medium and the heating temperature of the heater is so regulated that the preheating temperature for the recording medium is maintained within the predetermined temperature ranges.

Examples of the thermally dissociating encapsulated toners which is preferably used in the present invention will be described below, but the present invention is not restricted to these alone.

The toner used in the present invention is a thermally dissociating encapsulated toner. The encapsulated toner according to the present invention comprises a heat-fusible core containing at least a coloring agent and a shell formed thereon so as to cover the surface of the core material. In the present invention, the thermally dissociating encapsulated toner means a toner which comprises a shell whose structure is fragile to heat, and a core material which can be fixed at a low temperature by pressure. More particularly, the shell structure changes with heat, and at the point when pressure is applied, the core material is discharged to effect the fixing of the toner. Depending on the raw materials and production methods, a large variety of encapsulated toners are conceivable, and as long as they are within the range of the required thermal properties, there are no limitations on what production process or materials are used. Specifically, those having thermal properties capable of melting the toner on the recording medium heated in advance at a temperature range of between 50° C. and 160° C. and of fixing the toner by pressure of a pressure roller can be properly chosen. In general, the fixing temperature of the toner to the recording medium is in the range of between 40° C. and 120° C.

For example, the toner used in the present invention is an encapsulated toner produced by an interfacial polymerization method or a spray-drying method. In the interfacial polymerization method, a core material solution or dispersion is dispersed in a water in oil or oil in water type emulsion system, while at the same time shell material monomers (A) are collected around the surfaces, where in the next method, monomers (A) and monomers (B) react. In the spray-drying method, after the core material is dispersed in a non-aqueous solution of polymer or polymer-emulsion, the dispersed liquid is spray-dried. In the present invention, either method can be used for the production of the encapsulated toner. In the case of using the interfacial polymerization method, it not only has the merit of an easy function separation for the core material and shell material but also is capable of producing a uniform toner in an aqueous state. Moreover, substances of low softening points can be used for the core material in the interfacial polymerization method, making it particularly suitable from the aspect of fixing ability. Accordingly, in the present invention, the thermally dissociating encapsulated toner produced by the interfacial polymerization method among others is particularly preferred.

For shell materials, styrene resins (Japanese Patent Laid-Open No. 80407/1973), polyamide resins (Japanese Patent Laid-Open No. 66948/1983), epoxy resins (Japanese Patent Laid-Open No. 148066/1984), polyurethane resins (Japanese Patent Laid-Open No. 179860/1982), polyurea resins (Japanese Patent Laid-Open No. 150262/1987) and many others have been proposed. And as substances fixible under heat and pressure contained in the core material, thermoplastic resins having glass transition points (Tg) of between and 50° C. such as polyester resins, polyamide resins, polyester-polyamide resins, and vinyl resins can be used.

As compared to the thermal properties of the core material, the structure and the thermal properties of the shell material concern themselves remarkably with the fixing ability of the entire toner. Since a particular polyurethane resin among the above-mentioned resins for the shell materials is thermally dissociating, having excellent storage stability and fixing ability at a low temperature, it is an extremely favorable material for the method of forming fixed images of the present invention. As principal components of such a shell material, resins obtainable from the reaction between an isocyanate compound and/or isothiocyanate compound and compounds containing a phenolic hydroxy group and/or a thiol group are preferably used (EPO4538-57A).

The thermally dissociating encapsulated toner suitably used in the present invention can be produced by any known methods such as interfacial polymerization, etc., and this encapsulated toner is composed of a heat-fusible core material containing at least a coloring agent and a shell formed thereon so as to cover the surface of the core material, wherein the main components of the shell are a resin prepared by reacting:

(A) an isocyanate and/or isothiocyanate compound comprising:
  (1) 0 to 30 mol % of a monovalent isocyanate and/or isothiocyanate compounds, and
  (2) 100 to 70 mol % of at least a divalent isocyanate and/or isothiocyanate compounds with
(B) an active hydrogen compound comprising:
  (3) 0 to 30 mol % of a compound having one active hydrogen atom reactive with isocyanate and/or isothiocyanate groups and
  (4) 100 to 70 mol % of a compound having at least two active hydrogen atoms reactive with the isocyanate and/or isothiocyanate groups at a molar ratio of the component (A) to the component (B) of between 1:1 and 1:20, and wherein at least 30% of all of the linkages formed from the isocyanate or isothiocyanate groups are thermally dissociating linkages.

According to the present invention, the thermally dissociating linkage is preferably one formed by the reaction between a phenolic hydroxyl and/or thiol group and an isocyanate and/or isothiocyanate group.

The resins to be used as core materials of the encapsulated toner according to the present invention are thermoplastic resins having glass transition points (Tg) of 10° to 50° C., and such encapsulated toner of the present invention having a softening point of 80° to 150° C. can be used. Since the toner used in the method of the present invention is not subject to charging in the transfer process, not only insulating encapsulated toners but also conductive encapsulated toners can be used.

Next, the individual processes of the method of forming fixed images by the present invention having the above-mentioned construction will be described.

Figure 3:
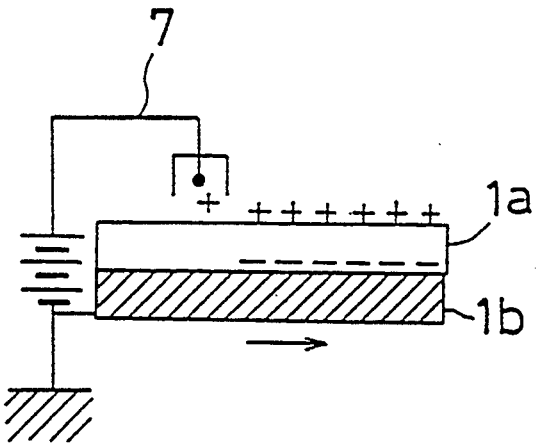
FIG. 3 is a schematic view showing the charging process in the method as defined by the present invention.
Figure 4:
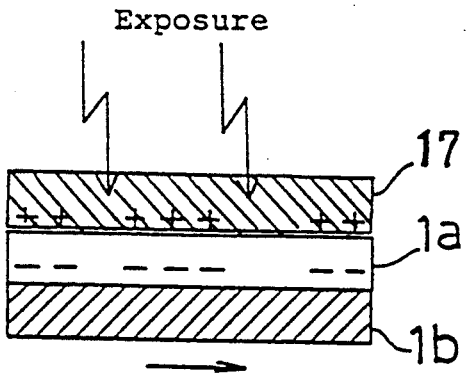
FIG. 4 is a schematic view showing the exposing process in the method as defined by the present invention.
Figure 5:
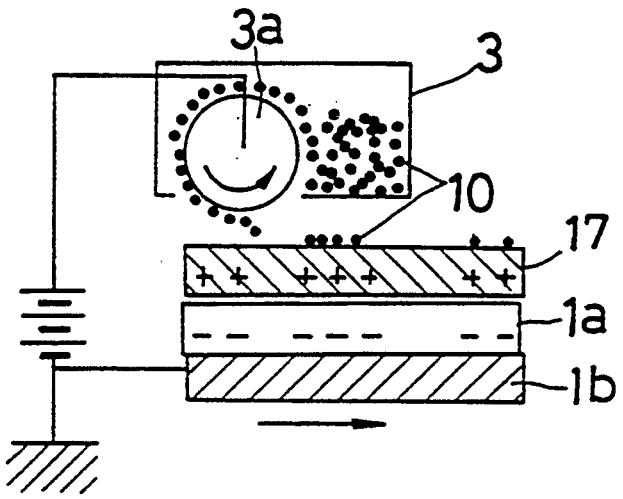
FIG. 5 is a schematic view showing the developing process in the method as defined by the present invention.
Figure 6:
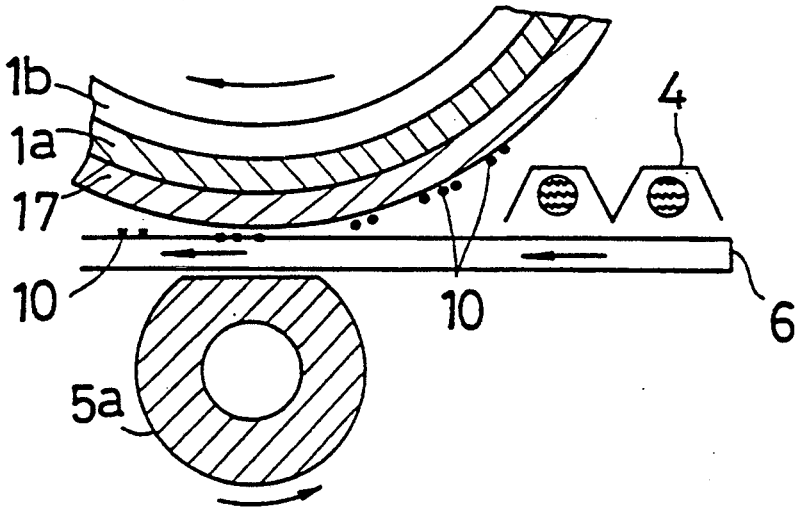
FIG. 6 is a schematic view showing the transfer and fixing process in the method as defined by the present invention.

FIG. 3 shows a charging process, FIG. 4 an exposing process, FIG. 5 a developing process and FIG. 6 a transfer and fixing process.

In the charging process, as shown in FIG. 3, a specified charge is uniformly supplied, e.g. by the corona charger 7 to the photoconductor surface. A photoconductor sensitive to a positive charge is taken here for an example, and the surface of the conductive supporter 1*b* is coated with the photoconductive layer 1*a* to form the photoconductor 1. A high voltage is applied by the corona charger 7 to the photoconductive layer 1*a*, thereby positively charging the surface of the photoconductive layer 1*a*.

Figure 2:
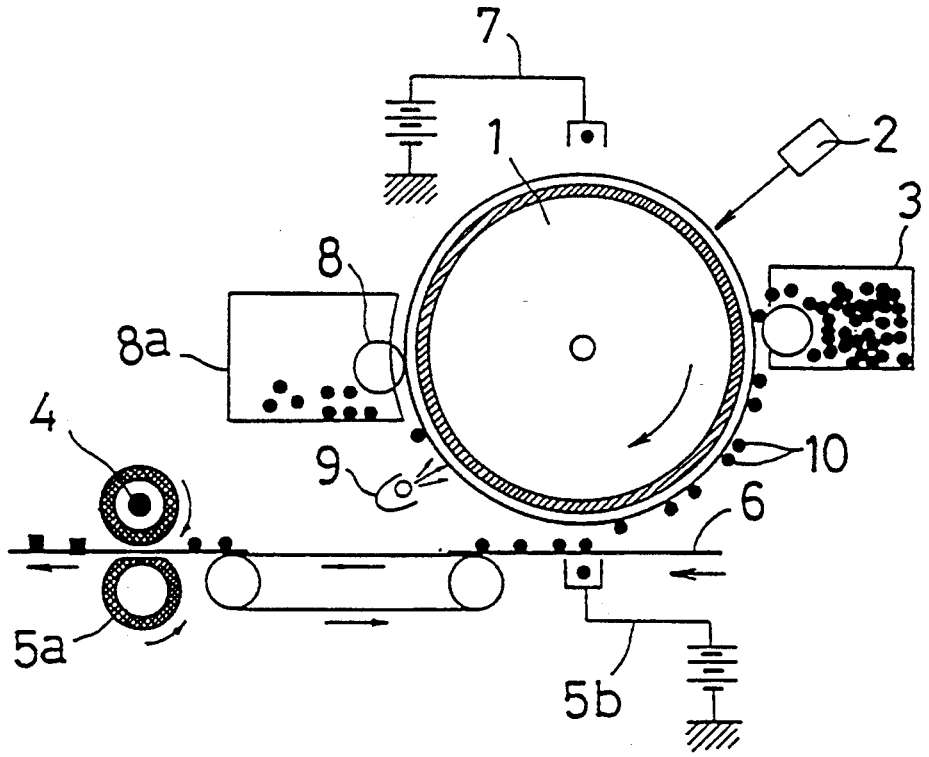
FIG. 2 is a schematic view of an apparatus used for conventional methods of forming fixed images.

In the exposing process, as shown in FIG. 2, a light from the exposure device 2 is irradiated to the surface of the photoconductor covered with the transfer film 17, so that a leakage of charges occurs only in the exposed parts and form an electrostatic latent image on the photoconductive layer 1*a*.

In the developing process, as shown in FIG. 5, the toner triboelectrically charged inside the developer device is transported by the rotating sleeve 3*a*, and developed onto the transfer film in proportion to the charge on the photoconductor surface. The developing process is an assortment of normal development in which a reversely polarized toner adheres to the charges by the Coulomb's force and of reverse development in which the toner adheres to the charges lost due to exposure to the light. The development process in the present invention applies to either method, but the case of the normal development is illustrated in FIG. 5.

In the transfer and fixing process, transfer and fixing are simultaneously carried out on the surface of the photoconductor covered with the transfer film. As shown in FIG. 6, the visible image formed by applying the toner to adhere to a latent image on the transfer film is conveyed. At the same time, a recording medium 6 such as a recording paper preheated by a heater 4 is pressure-welded on the transfer film by pressing the reverse side of the recording medium by a pressure roller 5*a* so as to synchronize with the initial end of the image, and thereby the visible image is simultaneously transferred and fixed onto the recording medium 6. In other words, when the toner adhered to the latent image formed on the surface of the heat-resistant photoconductor covered with the transfer film is pressure-welded to the recording medium, the deformation of the shell structure of the encapsulated toner due to the heat held in the recording medium takes place at the same time with the discharging of the core-material in the encapsulated toner due to pressure of the pressure roller. As stated above, the transfer process and the fixing process are carried out simultaneously at a position between the transfer film and one roller (pressure roller 5*a*). Alternatively, a belt can be used in the place of the roller, thereby carrying out transfer and fixing at a position between a transfer film and one belt. When the temperature applied to the surface of the recording medium by the heater 4 is too high, the recording paper tends to curl, and when it is too low, sufficient fixing of the toner cannot be achieved, making record preservation difficult. Therefore, the surface of the recording medium is usually heated to a temperature of between 50° C. and 160° C., preferably between 50° C. and 120° C.

In the present invention, since substantially all of the toner is transferred to the recording medium, a toner collecting device is not required. Incidentally, although trace amounts of the toner may remain on the surface of the transfer film 17 after the transferring of the toner to the recording medium 6, this toner can be removed by pressure-welding the transfer film with such devices as a cleaning web arranged opposite to the holding roller 16, making it possible to repeatedly use the transfer film.

Further, when the transfer and fixing process is completed, after removing the transfer film 17 from the photoconductor, the charges remaining on the photoconductor are neutralized by a charge eraser 9 such as a charge erasing lamp arranged opposite to the photoconductor 1, so that the photoconductor 1 is reused for the charging process.

In addition, the present invention is not confined to the above-mentioned embodiments, and specifications of the kinds of individual apparatus, processes etc. can be revised based on the principles of the present invention.

By using the method of forming fixed images of the present invention, the following effects can be obtained:

(1) Since the photoconductor is not directly in contact with the magnetic brush of the developer device, the cleaning blade, etc., the photoconductor can be protected, and thereby the durability becomes longer and the freedom in design becomes larger for the photoconductor.

(2) Since the photoconductor has a durability against heat, the durability thereof becomes longer.

(3) Since the fixing is carried out at a low temperature by using a toner having good fixing ability and by only preheating the recording medium, the fixing takes place by only using a pressure roller, thereby making the apparatus extremely compact.

(4) Since the heating temperature is low and the heat from the surface of the recording medium does not directly contact the pressure roller, a high heat resistance is not required for the pressure roller. Accordingly, inexpensive elastic members can be used as the materials of the pressure roller, and the duration of the roller becomes long.

(5) Since substantially all of the toner is transferred to the recording medium in the transfer and fixing process, little loss of the toner takes place, thereby causing substantially no toner to be discharged from the apparatus. Accordingly, the toner collecting box and the cleaning process can be simplified, thus making it possible to achieve low cost and miniaturization in the overall apparatus.

(6) Since the toner for the low-temperature fixing is used, the temperature of the heating body in the fixing device can be set low with only a small rise in the temperature in the system, thereby making it possible to miniaturize the forced radiation device.

(7) Since the surface of the recording medium is heated in a preheating process, a cardboard paper is also applicable for the method of the present invention.

(8) Since the fixing takes place without going through an electrostatic process, the conductive toners can also be used, and an electrostatic inducing-type development capable of applying low voltage can also be used.

The present invention is hereinafter described in more detail by means of the following working examples, but the present invention is not limited by them.

Production Example of Encapsulated Toner

To a mixture comprising 70.0 parts by weight of styrene, 30.0 parts by weight of 2-ethylhexyl acrylate and 1.0 part by weight of divinylbenzene, 10.0 parts by weight of carbon black "#44" (manufactured by Mitsubishi Chemical Industries, Ltd.), 4.0 parts by weight of 2,2'-azobisisobutyronitrile, 9.5 parts by weight of 4,4'-diphenylmethane diisocyanate "Millionate MT" (manufactured by Nippon Polyurethane Industry Co., Ltd.) are added. The obtained mixture is introduced into an attritor (manufactured by Mitsui Miike Kakoki) and dispersed at 10° C. for 5 hours to give a polymerizable composition. This composition is added to 800 g of a 4% by weight aqueous colloidal solution of tricalcium phosphate which has been preliminarily prepared in a 2-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes. A four-necked glass cap is set on the flask, and a reflux condenser, a thermometer, a dropping funnel fitted with a nitrogen inlet tube and a stainless steel stirring rod are set thereon. The resulting flask is placed on an electric mantle heater. A solution of 22.0 g of resorcinol, 3.6 g of diethyl malonate and 0.5 g of 1,4-diazabicyclo [2.2.2] octane in 40 g of ion-exchanged water is prepared, and the resulting mixture is dropped into the flask in a period of 30 minutes through the dropping funnel while stirring. Thereafter, the contents are heated to 80° C. and reacted for 10 hours in a nitrogen atmosphere while stirring. After cooling the reaction mixture, it is dissolved into 10%-aqueous hydrochloric acid. The resulting mixture is filtered and the obtained solid is washed with water, dried under a reduced pressure of 20 mmHg at 45° C. for 12 hours and classified with an air classifier to give the encapsulated toner with an average particle size of 9 μm having a shell made of a resin having a thermally dissociating urethane linkage. The glass transition point assignable to the resin contained in the core material is 30.2° C., and its softening point is 130.0° C.

Production Example of Reference Toner

To 100 parts by weight of a polyester resin (Bisphenol-type polyester resin; softening point: 135° C.; Tg: 65° C.), 7 parts by weight of carbon black (manufactured by Mitsubishi Kasei Ltd., MA8), 3 parts by weight of a polypropylene wax (Sanyo Kasei Ltd., Biscol 660P), and 2 parts by weight of a charge control agent (Orient Kagaku Kabushiki Kaisha, Bontron N-01) are mixed, and the resulting mixture is kneaded by a pressurized kneader. After cooling the obtained mixture, it is pulverized with a pulverizing mill and then classified with a classifier to obtain a toner having a particle distribution range of 5 to 25 μm and an average particle size of 10 μm. To 1 kg of the toner, 5 g of colloidal silica (Nihon Aerozil Ltd.: R972) is externally added to obtain a surface-treated reference toner.

TEST EXAMPLE 1

50 g of the toner obtained in Production Example of Encapsulated Toner is blended together with 1 kg of a commercially available coated ferrite carrier by using a V-type blender to obtain a developer 1. The obtained developer 1 is used to carry out copying by using a modified apparatus of a commercially available copying machine as schematically shown in FIG. 1. Specifically, a pigment sensitized zinc oxide photoconductor dispersed in resin is used as a photoconductor, a polycarbonate film manufactured by Gunze Limited having a thickness of 0.15 mm is used as a transfer film, and a quartz heater is used as a heater and arranged at a distance of 5 cm away from the point where the photoconductor contacts the pressure roller, arranged substantially parallel to the upper portion of the conveying route for the recording paper. In addition, by varying the heating temperature and the conveying velocity, the temperature on the surface of the recording paper is properly adjusted so as to preheat the paper surface to a temperature of between 60° C. and 160° C. The pressure roller used in the transfer and fixing is made of silicone rubber having a roller diameter of 30 mm $\phi$, and transfer and fixing are carried out at a nip pressure of 1.5 kg/cm and a peripheral speed of 80 mm/sec.

As a result, the lowest fixing temperature of the paper surface is 120° C., and substantially no melting of the toner to the surface of the photoconductor covered with the transfer film is observed at a temperature of between 100° C. and 160° C.

On the other hand, the toner obtained by the Production Example of Reference Toner is blended with a commercially available coated ferrite carrier to prepare a developer 2. Copying is carried out in the same manner as above using the modified apparatus. As a result, the lowest fixing temperature of the paper surface is 140° C.

The lowest fixing temperature for the toner is the temperature of the paper surface at which the fixing rate of the toner exceeds 70%. This fixing rate of the toner is determined by placing a load of 500 g on a sand-containing rubber eraser having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Co., and then calculating the fixing rate from this density value and a density value before the eraser treatment using the following equation.

$$\text{Fixing rate} = \frac{\text{Image density after eraser treatment}}{\text{Image density before eraser treatment}} \times 100$$

TEST EXAMPLE 2

The developer 1 obtained in Test Example 1 is used to carry out copying by using a modified apparatus of a commercially available copying machine as schematically shown in FIG. 1. Specifically, an organic photoconductor comprising a charge generation layer containing phthalocyanine dye and a charge transport layer containing hydrazone is used as a photoconductor, a polyethylene terephthalate film manufactured by Toray Industries, Inc. having a thickness of 0.15 mm is used as a transfer film, and a heating sheet is used as a heater and arranged at a distance of 5 cm away from the point where the photoconductor contacts the pressure roller. In addition, the temperature on the paper surface of the recording paper is properly adjusted so as to preheat the paper surface to a temperature of between 60° C. and 160° C. The pressure roller used in the transfer and fixing is made of EPDM having a roller diameter of 50 mm $\phi$, and the developer 1 obtained in Test Example 1 is used to carry out a continuous copying test for 50,000 sheets by adjusting to a nip pressure of 1.0 kg/cm and a peripheral speed of 160 mm/sec. As a result, under the condition in which the fixing temperature is 120° C., the fixing is good, and substantially no curling, jamming, etc. of the paper are observed. Also, substantially no disposed toner is observed.

On the other hand, the developer 2 obtained in Test Example 1 is used to carry out continuous copying in the same manner as above. As a result, the formed image was deteriorated due to the offset effect on the transfer film and the pressure roller after copying 5,000 sheets.

From these test examples, it is confirmed that by utilizing the method of forming fixed images according to the present invention using a thermally dissociating encapsulated toner, the lowest fixing temperature can be remarkably lowered, thereby resulting in no curling or jamming of the paper sheets fed to the copying machine.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of forming fixed images, comprising:

charging a heat-resistant photoconductor;

covering a surface of said heat-resistant photoconductor with a photopermeable transfer film;

exposing said transfer film and said heat-resistant photoconductor to light, thereby forming electrostatic latent images on the surface of said transfer film and said heat-resistant photoconductor;

developing said electrostatic latent images on the surface of said transfer film into a visible image by applying an encapsulated toner to said transfer film in the area of said electrostatic latent image;

simultaneously transferring said visible image onto a preheated recording medium and fixing the transferred visible image onto the recording medium by contacting said recording medium with the surface of said transfer film while said transfer film is in contact with the surface of said heat-resistant photoconductor.

2. The method according to claim 1, wherein said heat-resistant photoconductor is selected from the group consisting of a silicon photoconductor, a zinc oxide photoconductor dispersed in resin, and an organic photoconductor, and wherein said photoconductor comprises a tinder having a glass transition point of not less than 100°.

3. The method according to claim 1, wherein said transfer process and said fixing process are simultaneously carried out at a position between the transfer film and one roller or one belt.

4. The method according to claim 1, wherein said recording medium is preheated to a temperature of not less than 50° and not more than 160°.

5. The method according to claim 1, wherein said encapsulated toner is a thermally dissociating encapsulated toner which comprises a heat-fusible core material containing at least a coloring agent and a shell formed thereon so as to cover the surface of the core material, wherein the main component of the shell is a resin prepared by reacting:

(A) an isocyanate and/or isothiocyanate compound comprising:

(1) 0 to 30 mol % of monovalent isocyanate and/or isothiocyanate compounds, and (2) 100 to 70 mol % of at least divalent isocyanate and/or isothiocyanate compounds with (B) an active hydrogen compound comprising:

(3) 0 to 30 mol % of a compound having one active hydrogen atom reactive with the isocyanate and/or isothiocyanate groups and (4) 100 to 70 mol % of a compound having at least two active hydrogen atoms reactive with the isocyanate and/or isothiocyanate groups at a molar ratio of the component (A) to the component (B) of between 1:1 and 1:20, and wherein at least 30% of all of the linkages formed from the isocyanate or isothiocyanate groups are thermally dissociating linkages.

6. The method according to claim 5, wherein said thermally dissociating linkage is a linkage derived from reacting phenolic hydroxyl and/or thiol groups with the isocyanate and/or isothiocyanate groups.

7. The method according to claim 5, wherein said heat-fusible core material comprises a thermoplastic resin as its main component, whose glass transition point is 10° C. to 50° C.

8. The method according to claim 5, wherein the softening point of said thermally dissociating encapsulated toner is 80° C. to 150° C.

9. The method according to claim 1, wherein said recording medium is recording paper.

* * * * *